US006944888B1

(12) United States Patent
Canales, Jr.

(10) Patent No.: US 6,944,888 B1
(45) Date of Patent: Sep. 20, 2005

(54) SYSTEM FOR VENTING NOXIOUS FUMES FROM A TOILET

(76) Inventor: Amador Canales, Jr., 216 Farik Rd., Port Lavaca, TX (US) 77979-5919

( * ) Notice: Subject to any disclaimer, the term of this patent is extended or adjusted under 35 U.S.C. 154(b) by 0 days.

(21) Appl. No.: 10/914,030

(22) Filed: Aug. 6, 2004

(51) Int. Cl.[7] ..... E03D 9/04
(52) U.S. Cl. ..... 4/213
(58) Field of Search ..... 4/213, 216–217

(56) References Cited

U.S. PATENT DOCUMENTS 1,401,091 A * 12/1921 Lucas ..... 4/213
2,297,935 A 10/1942 Baither
2,949,615 A 8/1960 Farrell
3,691,568 A 9/1972 Martz
3,703,010 A 11/1972 Russell
3,763,505 A 10/1973 Zimmerman
3,781,923 A * 1/1974 Maisch et al. ..... 4/213
4,017,916 A * 4/1977 Pearson ..... 4/213
4,232,406 A 11/1980 Beeghly et al.
4,581,780 A 4/1986 Hoskins et al.
4,893,359 A * 1/1990 Vu et al. ..... 4/216
5,029,346 A 7/1991 Fernald, Sr.
5,394,569 A 3/1995 Poirier et al.
2002/0002735 A1 1/2002 Moon

* cited by examiner

*Primary Examiner*—Charles E. Phillips
(74) *Attorney, Agent, or Firm*—Richard L. Miller

(57) ABSTRACT

A system for venting noxious fumes from a toilet. A toilet seat weight-sensing switch operatively connects to a fan and activates when the seat of the toilet is sat upon. A toilet flush handle switch activates when the flush handle of the toilet activates. A timer circuit activates when the toilet flush handle switch is activated. A logic gate operatively connects to the toilet seat weight-sensing switch, the timer circuit, and the fan. When the seat of the toilet is sat upon, the toilet seat weight-sensing switch generates a pulse turning on the logic gate which generates a pulse which turns on the fan. When the flush handle of the toilet activates, the toilet flush handle switch generates a pulse turning on the timer circuit which after a predetermined time generates a pulse which turns off the logic gate which turns off the fan.

12 Claims, 2 Drawing Sheets

SYSTEM FOR VENTING NOXIOUS FUMES FROM A TOILET

BACKGROUND OF THE INVENTION

1. Field of the Invention

The present invention relates to a toilet, more particularly, the present invention relates to a system for venting noxious fumes from a toilet.

2. Description of the Prior Art

Numerous innovations for vented toilets have been provided in the prior art that will be described. Even though these innovations may be suitable for the specific individual purposes to which they address, however, they differ from the present invention.

A FIRST EXAMPLE, U.S. Pat. No. 2,997,935 to Baither teaches a ventilated toilet comprising a bowl having a water basin therein and a drainpipe below the basin and communicating therewith, means for creating a suction in the bowl above the water basin including an electric motor and a fan, a protecting housing for the motor and fan entirely enclosing the same and constituting a foul odor receiving chamber, means connecting the interior of the housing with the bowl, the inlet of the fan communicating with the interior of the housing, a reservoir and trap chamber arranged above the drainpipe and the bottom of the bowl, means connecting the outlet of the fan with the reservoir and trap chamber above the normal water level therein, and means connecting the drain of the toilet with the water reservoir and trap chamber above the normal water level therein.

A SECOND EXAMPLE, U.S. Pat. No. 2,949,615 to Farrell teaches a water closet ventilator comprising a bowl and associated flush tank, a over on the flush tank provided with passageways therein communicating the interior and exterior of the flush tank and valve means in each of the passageways adapted to permit selective entry of a gas through a first passage into the interior of the flush task and selective exit of a gas through a second passage from the flush tank.

A THIRD EXAMPLE, U.S. Pat. No. 3,691,568 to Martz teaches a ventilator attachment for bathrooms and the like which is adapted for use with the ventilator disclosed in application Ser. No. 882,815 so that the ventilator disclosed in the application may be employed with water tanks in which, for example, the overflow channel or pipe is integral with a wall of the tank. This attachment employs a tube having one end fitting into the inlet of the ventilator hood and the other end fitting into the overflow pipe of the tank. An elbow pipe having one end attached to the tube and having the other end positioned below the water line of the tank is provided to drain any excess water into the overflow pipe. Another embodiment of this device employs a T-type coupling for connecting the ventilator pipe to the water pipe leading to the toilet bowl in flush-type toilets. This T-type connection is provided with a baffle inside thereof to deflect the water flow therethrough and keep it from flowing into the ventilator pipe.

A FOURTH EXAMPLE, U.S. Pat. No. 3,703,010 to Russell teaches an improved ventilator means for a toilet. The ventilator mens includes a suction means having a regulating valve to reduce suction in the toilet flush tank when the toilet is flushed.

A FIFTH EXAMPLE, U.S. Pat. No. 3,763,505 to Zimmerman teaches a toilet having a toilet bowl and a flush tank on the bowl in which an overflow pipe discharges overflow water into the toilet bowl and conducts obnoxious air and gases and odors from the toilet bowl into an air space above the water level in the tank, a ventilator casing which fits over the open top of the flush tank and bottom of the ventilator casing being substantially in the same proportions as the usual lid for the flush tank and it has an intake hole therethrough. A suitable blower or fan mounted on the bottom is located inside the casing. The walls of the casing are closed all around but are provided with charcoal filters for deodorizing and cleaning the air passing through the filters. The fan is driven by an electric motor from a suitable battery contained in the casing, and is controlled by a time switch so that the fan draws the air from the air space on the top of the tank and exhausts it through the filters. In a modified form a perforated hollow exhaust tube is placed either on the open top of the toilet bowl or on the toilet bowl cover with perforations in its inner periphery and is provided with a flexible connection into the casing of the ventilator capable of being set on the floor for directly drawing the air from the bowl and under the toilet seat into the casing and purifying it through the the filters. This separately located unit is also provided on one of its walls with compartments for magazines or the like.

A SIXTH EXAMPLE, U.S. Pat. No. 4,232,406 to Beeghly et al. teaches a system for ventilating the toilet bowl of a water closet of the type having a standpipe in the flush tank thereof and wherein the lower end of the standpipe is connected to the conduit which extends between the flush tank and the flush ring in the toilet bowl and the upper end of the standpipe extends above the normal level of the water in the flush tank. The inlet of a suction fan communicates with the space above the level of the water in the flush tank and the outlet of the fan is connected to a suitable point of discharge for gases withdrawn from the toilet bowl. A vent passage extends from the exterior of the flush tank to the space above the level of the water in the flush tank, and a normally closed flapper valve, which is connected by linkage to a float that floats on the surface of the water in the flush tank, moves to an open position to prevent a vacuum from developing in the space above the level of the water in the flush tank when the tank is flushing the toilet bowl and the water level in the tank drops.

A SEVENTH EXAMPLE, U.S. Pat. No. 4,581,780 to Hoskins et al. teaches an outdoor toilet constructed of precast concrete having integral color incorporated therein with the external surfaces being simulative of wood or the like and provided with a vault with a vent stack extending upwardly along one wall of the toilet and communicating with the vault and with a vent cap on the roof of the toilet to provide an offset passageway for venting the vault by using the chimney effect of the vent stack and vent cap. The vent stack includes an access opening in the exterior wall thereof provided with a closure to enable pump out of the vault from a point externally of the toilet. The toilet includes a toilet riser, handrail, toilet tissue holder, window and louver vents and an access door associated with an entrance slab and screen panels along two edges of the entrance slab to prevent direct observation into the interior of the toilet when the door is open. The entrance slab is supported by cantilever arms integral with the vault at one end edge thereof.

AN EIGHTH EXAMPLE, U.S. Pat. No. 5,029,346 to Fernald, Sr. teaches a system for venting odors from a toilet having a bowl with a plurality of openings disposed about its rim and a tank to store water with a bowl fill tube interconnected with the openings. A vent is positioned above the level of maximum water storage in the tank. A low pressure region within the vent is established bias air flow through bowl rim openings in the toilet and also through a bowl fill tube in the toilet tank and into the vent. Finally, an exhaust outlet is located at a remote point from the toilet in order to output the air flow from the toilet. To improve venting of air flow between the vent and the fill tube, the tank lid may include a seal positioned between the lid and the tank. The system may also include a valve with dampers that allow air flow to enter the tank during flushing and allow air flow to exit the tank during venting, but that limits air flow when the system is inoperative.

A NINTH EXAMPLE, U.S. Pat. No. 5,394,569 to Poirier et al. teaches an air venting apparatus to be mounted into the water tank of a water closet for evacuating to the outside of the room where the water closet is located the stale air escaping from the toilet bowl. The apparatus comprises a main, generally closed air chamber; a powered fan member, anchored into the air chamber for developing negative pressure therein; a support for supporting the air chamber at the top portion of the water tank whereby the fan remains constantly above water level. A siphon assembly is provided for fluidingly interconnecting in substantially air tight fashion the discharge pipe to an upstream section of the air chamber, whereby the siphon assembly is adaptable to fit discharge pipes of variable locations within the water tank; and a nozzle assembly is provided for fluidingly interconnecting a downstream end of the air chamber to the outside of the room. No modification of the water tank nor the water tank lid is required for the installation of this apparatus.

A TENTH EXAMPLE, U.S. Patent Application Publication No. 2002/0002735 A1 to Moon teaches a toilet bowl including a body in which feces are contained and a seat plate on which bottoms of a user directly touch, wherein the apparatus comprises: a plurality of suction inlets formed underneath the seat plate for sucking in air within the body; a suction passage formed along a margin of the seat plate for collecting the air sucked in through the plurality of suction inlets to discharge same thereafter; a blower mounted in communication with the suction passage; and a drain passage communicating with a discharge outlet of the blower, such that stench generated while a user relieves himself or herself is eliminated to be discharged through a drain pipe such that displeasure in and out of the toilet room can be removed.

It is apparent that numerous innovations for vented toilet have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a system for venting noxious fumes from a toilet that avoids the disadvantages of the prior art.

BRIEFLY STATED, ANOTHER OBJECT of the present invention is to provide a system for venting noxious fumes from a toilet. A toilet seat weight-sensing switch operatively connects to a fan and activates when the seat of the toilet is sat upon. A toilet flush handle switch activates when the flush handle of the toilet activates. A timer circuit activates when the toilet flush handle switch is activated. A logic gate operatively connects to the toilet seat weight-sensing switch, the timer circuit, and the fan. When the seat of the toilet is sat upon, the toilet seat weight-sensing switch generates a pulse turning on the logic gate which generates a pulse which turns on the fan. When the flush handle of the toilet activates, the toilet flush handle switch generates a pulse turning on the timer circuit which after a predetermined time generates a pulse which turns off the logic gate which turns off the fan.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 2:
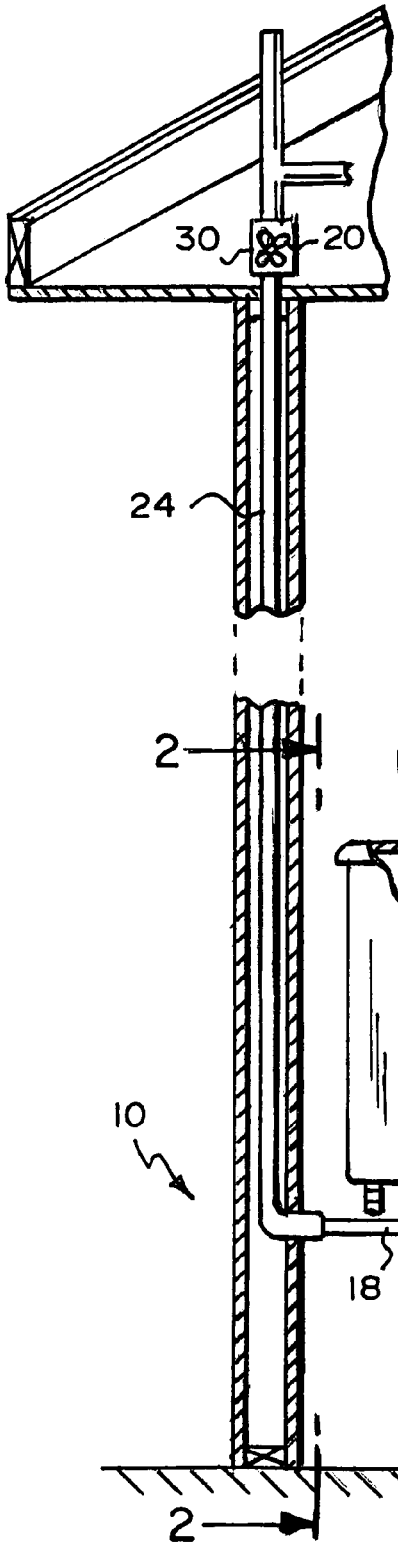
FIG. 2 is a rear elevational view taken along line 2—2 in FIG. 1 showing the toilet with the bowl discharge vents installed therein.
Figure 2:
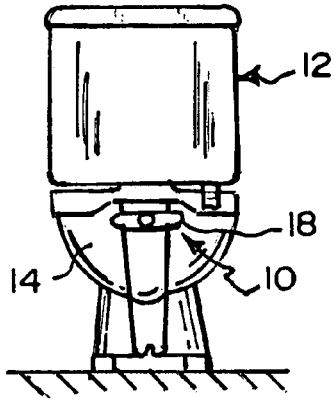

10 system of present invention for venting noxious fumes from toilet 12
12 toilet
14 bowl of toilet 12
16 seat of toilet 12
17 flush handle of toilet 12
18 conduit for communicating with bowl 14 of toilet 12 and for extending straddlingly rearwardly from bowl 14 of toilet 12
20 fan for venting noxious fumes from toilet 12
22 activator
24 vent stack for extending into ambient
30 housing
32 toilet seat weight-sensing switch for disposing under seat 16 of toilet 12 and for activating when seat 16 of toilet 12 is sat upon
34 toilet flush handle switch for operatively connecting to flush handle 17 of toilet 12 and for activating when flush handle 17 of toilet is activated
36 timer circuit
38 logic gate
$V_S$ pulse generated by toilet seat weight-sensing switch 32 when seat 16 of toilet 12 is sat upon and turning on logic gate 38
$V_M$ pulse generated by logic gate after receiving pulse $V_S$ and turning on fan 20
$V_F$ pulse generated by toilet flush handle switch 34 when flush handle 17 of toilet 12 is activated and activating timer circuit 36
$V_T$ pulse generated by timer circuit 36 after receiving pulse $V_F$ and after predetermined time and turning off logic gate 38

DETAILED DESCRIPTION OF THE PREFERRED EMBODIMENT

Figure 1:
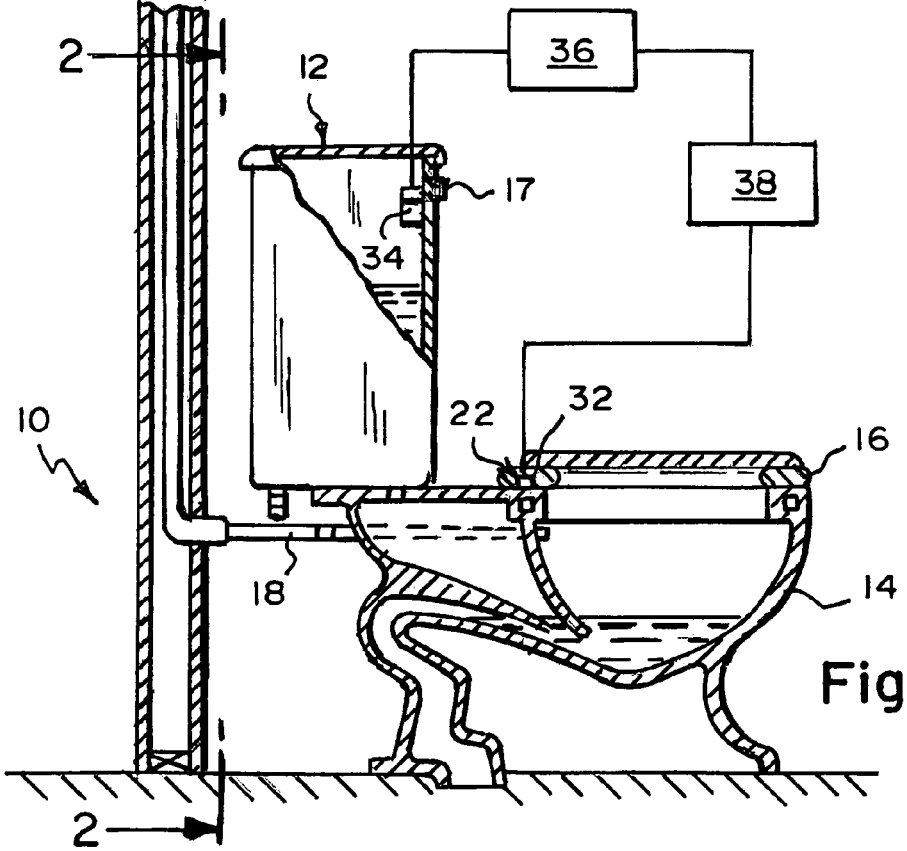
FIG. 1 is a diagrammatic elevational view partially in section, with parts broken away, showing the present invention installed and ready for use.

Referring now to the figures, in which like numerals indicate like parts, and particularly to FIGS. 1 and 2, the system of the present invention is shown generally at 10 for venting noxious fumes from a toilet 12. The toilet 12 has a bowl 14, a seat 16, and a flush handle 17.

The system 10 comprises a conduit 18, a fan 20, and an activator 22. The conduit 18 is for communicating with the bowl 14 of the toilet 12. The fan 20 communicates with the conduit 18 and is for venting the noxious fumes from the toilet 12. The activator 22 is operatively connected to the fan 20.

The conduit 18 is generally Y-shaped and is for extending straddlingly rearwardly from the bowl 14 of the toilet 12.

The system 10 further comprises a vent stack 24. The vent stack 24 extends communicatingly from the conduit 18 and is for extending into the ambient.

The system 10 further comprises a housing 30. The housing 30 communicates with the vent stack 24 and contains the fan 20.

The activator 22 comprises a toilet seat weight-sensing switch 32. The toilet seat weight-sensing switch 32 of the activator 22 is operatively connected to the fan 20, is for disposing under the seat 16 of the toilet 12, and is for activating when the seat 16 of the toilet 12 is sat upon.

The system 10 further comprises a toilet flush handle switch 34. The toilet flush handle switch 34 is for operatively connecting to the flush handle 17 of the toilet 12 and is for activating when the flush handle 17 of the toilet is activated.

The system 10 further comprises a timer circuit 36. The timer circuit 36 is operatively connected to the toilet flush handle switch 34 and activates when the toilet flush handle switch 34 is activated.

The system 10 further comprises a logic gate 38. The logic gate 38 is operatively connected to the toilet seat weight-sensing switch 32, the timer circuit 36, and the fan 20.

Figure 3:
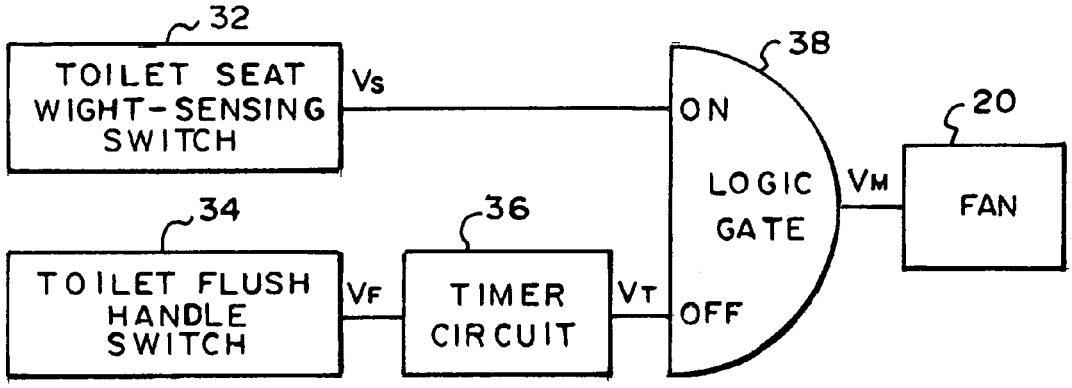
FIG. 3 is a block diagram of the present invention.
Figure 4:
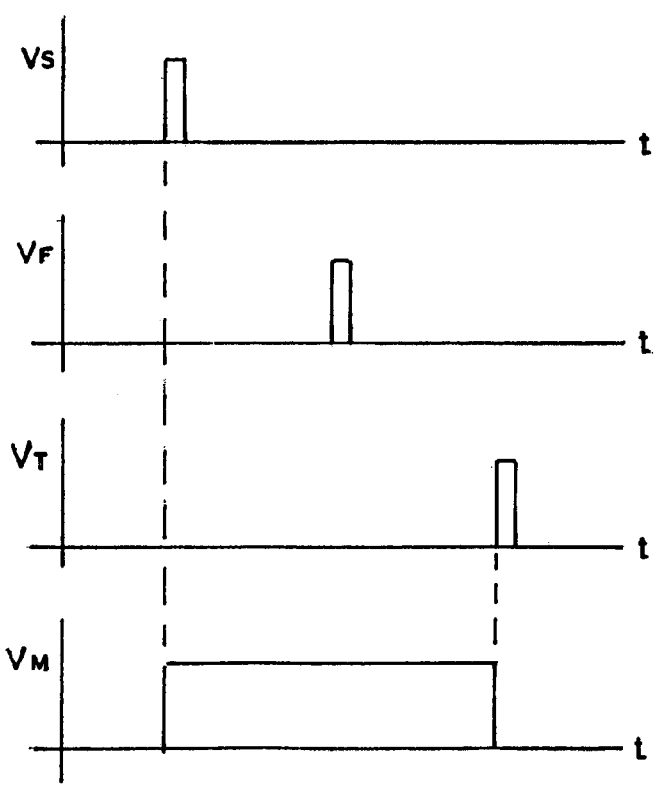
FIG. 4 is a timing diagram showing the sequence of logical operations that occur when the system is utilized.

The operation of the system 10 can best be seen in FIGS. 3 and 4, and as such, will be discussed with reference thereto.

When the seat 16 of the toilet 12 is sat upon, the toilet seat weight-sensing switch 32 generates a pulse $V_S$ which turns on the logic gate 38 which generates a pulse $V_M$ which turns on the fan 20. When the flush handle 17 of the toilet 12 is activated, the toilet flush handle switch 34 generates a pulse $V_F$ which turns on the timer circuit 36 which after a predetermined time generates a pulse $V_T$ which turns off the logic gate 38 which turns off the fan 20.

It will be understood that each of the elements described above, or two or more together, may also find a useful application in other types of constructions differing from the types described above.

While the invention has been illustrated and described as embodied in a system for venting noxious fumes from a toilet, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A system for venting noxious fumes from a toilet, comprising:

a) a conduit;

b) a fan; and c) an activator;

wherein said conduit is for communicating with the toilet;

wherein said fan communicates with said conduit;

wherein said fan is for venting the noxious fumes from the toilet; and wherein said activator is operatively connected to said fan, wherein the toilet has a seat;

wherein said activator comprises a toilet seat weight-sensing switch;

wherein said toilet seat weight-sensing switch of said activator is operatively connected to said fan;

wherein said toilet seat weight-sensing switch of said activator is for disposing under the seat of the toilet; and wherein said toilet seat weight-sensing switch of said activator is for activating when the seat of the toilet is sat upon, wherein the toilet has a flush handle;

further comprising a toilet flush handle switch;

wherein said toilet flush handle switch is for operatively connecting to the flush handle of the toilet; and wherein said toilet flush handle switch is for activating when the flush handle of the toilet is activated; further comprising a timer circuit;

wherein said timer circuit is operatively connected to said toilet flush handle switch; and wherein said timer circuit activates when said toilet flush handle switch is activated; further comprising a logic gate;

wherein said logic gate is operatively connected to said toilet seat weight-sensing switch;

wherein said logic gate is operatively connected to said timer circuit; and wherein said logic gate is operatively connected to said fan.

2. The system as defined in claim 1, wherein the toilet has a bowl; and wherein said conduit is for communicating with the bowl of the toilet.

3. The system as defined in claim 1, wherein said conduit is generally Y-shaped.

4. The system as defined in claim 1, wherein said conduit is for extending straddlingly rearwardly from the bowl of the toilet.

5. The system as defined in claim 1;

further comprising a vent stack;

wherein said vent stack extends communicatingly from said conduit; and wherein said vent stack is for extending into the ambient.

6. The system as defined in claim 5; further comprising a housing;

wherein said housing communicates with said vent stack; and wherein said housing contains said fan.

7. The system as defined in claim 1, wherein said toilet seat weight-sensing switch generates a first pulse when the seat of the toilet is sat upon.

8. The system as defined in claim 7, wherein said first pulse turns on said logic gate which generates a second pulse.

9. The system as defined in claim 8, wherein said second pulse turns on said fan.

10. The system as defined in claim 9, wherein said toilet flush handle switch generates a third pulse when the flush handle of the toilet is activated.

11. The system as defined in claim 10, wherein said third pulse turns on said timer circuit which after a predetermined time generates a fourth pulse.

12. The system as defined in claim 11, wherein said fourth pulse turns off the logic gate which turns off said fan.

* * * * *